United States Patent [19]

Green

[11] Patent Number: 4,767,969

[45] Date of Patent: Aug. 30, 1988

[54] RF EMISSION SHIELD FOR CRT DISPLAYS

[75] Inventor: Joseph A. Green, Prince Georges County, Md.

[73] Assignee: Honeywell, Inc., Minneapolis, Minn.

[21] Appl. No.: 53,763

[22] Filed: May 26, 1987

[51] Int. Cl.[4] ..... H01J 1/52

[52] U.S. Cl. ..... 315/85; 315/4; 315/8; 313/479

[58] Field of Search ..... 315/4, 5, 8, 85; 313/458; 335/213, 214

[56] References Cited

U.S. PATENT DOCUMENTS

| | | | |
|---|---|---|---|
| 2,567,874 | 9/1951 | Cage | 313/458 |
| 3,106,658 | 10/1963 | Chandler et al. | 315/8 |
| 3,404,307 | 10/1968 | Hayden | 315/8 |
| 3,824,515 | 7/1974 | Holman | 335/213 |
| 3,867,668 | 2/1975 | Shrader | 315/85 |
| 4,243,913 | 1/1981 | Nero | 315/85 |
| 4,392,078 | 7/1983 | Nobel et al. | 315/4 |
| 4,392,083 | 7/1983 | Costello | 315/8 |
| 4,556,821 | 12/1985 | Cooper | 315/85 |
| 4,695,694 | 9/1987 | Hill et al. | 315/85 |

*Primary Examiner*—David K. Moore

*Assistant Examiner*—Michael Razavi

*Attorney, Agent, or Firm*—C. Lamont Whitham; Michael E. Whitham

[57] ABSTRACT

Certain applications require a CRT display to be well shielded against emitting RF electromagnetic energy. A shield placed at the neck portion of a CRT envelope inhibits RF emissions from being transmitted through the face portion of the CRT. The shield comprises longitudinal conductors for suppressing transverse magnetic ($TM_{01}$, $TM_{02}$ . . . ) mode emissions and circular conductors for suppressing transverse electric ($TE_{01}$, $TE_{02}$ . . . ) mode emissions. Placing the shield at the rear of the CRT envelope eliminates the need for covering the face portion of the CRT with an optically transparent screen. To eliminate RF emissions from the CRT display the housing is provided with a contiguous RF emission shield that is connected to the shield on the neck of the CRT. Alternatively, an internal RF emission shield would enclose the video circuitry which includes all potential sources of undesired RF emission. The internal RF emission shield would likewise be connected to the shield on the neck of the CRT.

6 Claims, 2 Drawing Sheets

RF EMISSION SHIELD FOR CRT DISPLAYS

BACKGROUND OF THE INVENTION

1. Field of the Invention

The present invention generally relates to a means for inhibiting radio frequency (RF) emissions from a cathode ray tube (CRT) display face and, more particularly, to an RF emission inhibiting means located at the rear surface of the CRT envelope.

2. Description of the Prior Art

The large aperture usually required by a CRT display in the wall of an otherwise well-shielded enclosure presents a potential shielding deficiency. Internally generated electromagnetic energy may be transmitted through such an aperture with relatively minor attenuation. RF emissions have generally been combatted by using a transparent conducting screen to cover the face of the CRT. The conductive screen may comprise either a wire mesh or a thin homogenous layer. The screen is bonded along its entire periphery to the enclosure wall, thus completing a conducting envelope surrounding all potential radiators.

Unfortunately wire meshes and homogeneous layers have practical limitations when the restrictions on RF emission are severe. Brightness and spatial resolution penalties result with the use of a wire mesh. Moreover, annoying moire patterns are formed as a consequence of the interaction of the geometric periodicity of the mesh and the raster scan lines or dot matrix CRT phosphor geometry. A homogenous conductive film generally comprises either metallic gold or indium-tin-oxide (ITO). The homogenous conductive film must be made thicker to increase shielding effectiveness. Optical transparency of the homogenous conductive film diminishes with increased thickness and therefore a compromise on thickness is usually made which is neither satisfactory in terms of transparency nor satisfactory in terms of RF emission shielding.

The inherent problems with a transparent conducting screen for shielding RF emissions from a CRT display face can be anticipated to have an ever increasing impact on the electrical and optical performance of display systems of evolving bandwidth, optical resolution, and physical size. Transparent conducting screens have a high material cost and require a high labor cost because of the delicate bonding operations.

U.S. Pat. No. 2,217,409 to Hepp is directed to a CRT control apparatus and discloses sheathing the deflection coils with conductive material comprising wound wire. An electrostatic screen made of helically wound nonmagnetic material separates the inner pair of deflection coils from the outer pair. The whole of the coil system is surrounded by a helically wound sheath of magnetic material which closes the lines of force and is coaxial with the neck of the CRT. U.S. Pat. No. 3,824,515 to Holman shows a cylindrical electric screening used in the deflection units of CRTs. The electric cage comprises two adjacent helically wound wires with one end of each wire being connected to ground and the grounded ends being located at opposite ends of the neck tube of the CRT.

U.S. Pat. No. 2,567,874 to Cage and U.S. Pat. No. 2,623,923 to Zimmerman employ Faraday cages comprising longitudinal conductors disposed in an essentially cylindrical geometry. The longitudinal conductors are shown on the inside of a CRT envelope in the Cage patent. The purpose of Cage's arrangement is to provide a better electron return path within the CRT so that higher accelerating potentials can be applied resulting in increased brightness. The arrangement also shields the electron beam from exterior electric fields. The patent to Zimmerman is directed to an electrostatically shielded magnetic well logging system. The Faraday cage permits electromagnetic coupling between a sensitive measuring system and earth formations adjacent a well bore and prevents electrostatic coupling.

U.S. Pat. No. 4,392,083 to Costello shows a radiation shield for a CRT neck which shields proximate conductors from neck emissions. a plurality of elongated, coaxially oriented, spaced, conductive elements are bonded to the inner surface and outer surface of a sleeve of insulating material. The inner conductive elements are offset from the outer conductive elements. A conductive ring is connected to each of the inner elements and outer elements at one end of the sleeve and the ring is connected to ground potential by a drain strap. The neck shield disclosed in the Costello patent renders electromagnetic radiation from the CRT neck greatly attenuated while the magnetic field generated by the yoke is allowed to pass through the shield with relatively low attenuation.

There is no teaching in the prior art of a means for shielding RF emissions from the display face of a CRT which entirely avoids the need for an optically transparent screen in front of the display face of the CRT. Moreover, there is no teaching which anticipates moving the RF radiation barrier from its conventional location in front of the CRT face to the rear surface of the CRT envelope.

SUMMARY OF THE INVENTION

It is therefore an object of this invention to provide an alternative method of shielding RF emissions from CRT displays which eliminates the need for an optically transparent screen in front of the face of a CRT display.

It is a further object of this invention to provide an RF emission shield of inverted topology wherein a shield at the rear of the CRT envelope prevents RF emissions from the face of the CRT display.

It is a further object of the invention to provide a RF emission shield of lower material and labor cost.

According to the invention, the CRT neck is surrounded by a conducting surface which acts as a cylindrical waveguide. The waveguide is coaxially aligned with the neck of the CRT and contiguous with it in order to act as a high pass filter. Electromagnetic energy with a frequency below the waveguide cutoff, which includes frequencies less than one gigahertz (GHz), is suppressed. In this invention, transmission of energy at frequencies associated with the video waveform including lower order harmonics are highly attenuated by the waveguide, thus frustrating egress of radiation from the CRT display face at these frequencies.

The potential sources of undesired RF emission are included in the video circuitry itself. For example, video amplifiers and video drivers emit electromagnetic energy which can be transmitted with relatively slight attenuation through an unshielded CRT display face. Generally the modulated electron beam current in the CRT does not play a significant role in the emission of RF energy by virtue of its minute absolute value. Usually no correlation is found between the video associated RF energy observed external to unshielded or poorly shielded displays and the brightness setting which is related to the average beam current. Even in a dark display with the electron beam biased completely OFF there is ordinarily no perceptible diminution of video related RF energy.

Problems are associated with placing a waveguide on the CRT neck. The interposition of a continuous isotropically conducting waveguide wall between the deflecting coils and the electron beam would effectively shield the electron beam from the deflection field itself. Additionally, the waveguide would behave as a shorted-turn secondary winding on a transformer whose primary winding is the deflection coil. Therefore, the shield has been constructed to avoid the associated problems while permitting the high pass action characteristic of the waveguide for various potential waveguide modes.

The shield comprises a set of narrow, parallel, longitudinal conductors which hereinafter will be called fingers and a set of narrow, parallel, circular conductors which hereinafter will be called hoops. The fingers bestow only the longitudinal conductivity required to support the transverse magnetic ($TM_{01}$, $TM_{02}$ . . . ) guide modes. The hoops yield the circumferential conductivity needed to support the transverse electric ($TE_{01}$, $TE_{02}$ . . . ) guide modes. The sets of fingers and hoops are not joined together electrically except along a single longitudinal finger if necessary for mechanical support or for facilitating fabrication. The longitudinal fingers can be connected together electrically at one end but not both ends. This topology prevents the formation of paths in which eddy currents could be induced by the deflecting fields but, at the same time, it would endow the shield with both longitudinal and circumferential conductivities. For transverse magnetic ($TM_{01}$, $TM_{02}$ . . . ) mode suppression, the longitudinal conductivity provided by the fingers is sufficient. For transverse electric ($TE_{01}$, $TE_{02}$ . . . ) mode suppression, however, only the circumferential conductivity due to the hoops is effective.

Although the Costello patent noted in the prior art is explicitly concerned with the shielding of proximate conductors from neck emissions and consequent reradiation from the latter, the structure as described would also thwart the egrees of transverse magnetic ($TM_{01}$, $TM_{02}$ . . . ) mode radiation through the display face of the CRT. The geometry proposed by Costello would form a circular waveguide operated below cutoff and would therefore effectively attenuate a forwardly propagating wave, but the Costello patent makes no reference to the role of this mechanism. Moreover, the geometry in Costello would not suppress transverse electric ($TE_{01}$, $TE_{02}$ . . . ) mode radiation. Asymmetries, principally caused by off-axis conductors associated with the electrodes and adjacent circuits, can cause transverse electric mode excitation. The hoops are critical in the case of CRTs having asymmetrical arrangements of leads which extend inside the neck of the CRT.

RF emissions from a CRT housing are suppressed by a shielded enclosure which contains the CRT envelope wherein the CRT envelope has a waveguide neck shield and a non-shielded CRT face. Alternatively, the sources of potential undesired emission are contained within their own enclosure near the CRT base and this enclosure is bonded to the neck shield on the CRT. The alternative shielding configuration would eliminate the requirement for shielding the entire CRT housing.

BRIEF DESCRIPTION OF THE DRAWINGS

The foregoing and other objects, aspects and advantages of the invention will be better understood from the following detailed description of the preferred embodiments of the invention with reference to the accompanying drawings, in which.

DETAILED DESCRIPTION OF THE PREFERRED EMBODIMENTS OF THE INVENTION

Figure 1:
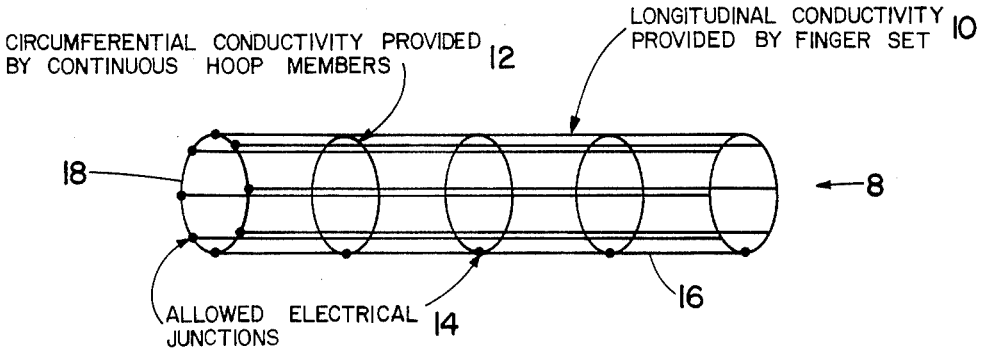
FIG. 1 is a three dimensional view of the sets of fingers and sets of hoops which comprise the RF emission shield according to the invention.

Referring now to the drawings, and more particularly to FIG. 1, the RF emission shield according to the invention is shown generally at 8 as comprising a set of fingers 10 and a set of hoops 12. The finger set 10 comprises a plurality of narrow, parallel, longitudinally conductive fingers. Orthogonal to the finger set 10 is the hoop set 12 which comprises a plurality of narrow, parallel, circumferentially conductive hoops. The finger set 10 provides the longitudinal conductivity required to support the transverse magnetic guide modes. Below the cutoff frequency the finger set 10 suppresses only transverse magnetic mode radiation. The hoop set 12 yields the circumferential conductivity required to support the transverse electric guide modes. Below the cutoff frequency the hoop set 12 suppresses only transverse electric mode radiation. The finger set 10 and the hoop set 12 are not joined together electrically except at allowed electrical junctions 14 which give mechanical support and facilitate the RF emission shield's fabrication. The allowed electrical junctions 14 occur between a single longitudinal finger 16 and the all the hoops of the hoop set 12 and also, all the fingers of the finger set 10 are connected at one end 18 of the hoop set 12 but not both ends. The finger set 10 and the hoop set 12 may be printed on opposite sides of a flexible dielectric support using well known and conventional printed circuit techniques.

The shield thus described may be employed in a typical CRT display. The following dimensions are given to indicate a practical geometry:

Conducting material thickness: 0.003 inches
Finger or Hoop width: 0.038 inches
Center to Center Finger/Hoop Spacing: 0.058 inches
Insulation thickness: 0.002 inches
Length of Finger System: 2.00 inches
Diameter of Finger Stock: 1.18 inches
$TM_{01}$ Mode Cutoff Wave Length: 2.61 a
$TE_{01}$ Mode Cutoff Wave Length: 1.64 a
where a is the Guide Radius In the example given, the corresponding cutoff frequencies will be; $TM_{01}$ equal to 7.7 GHz and $TE_{01}$ equal to 12.2 GHz. Below these frequencies mode propagation will be attenuated.

Figure 2:
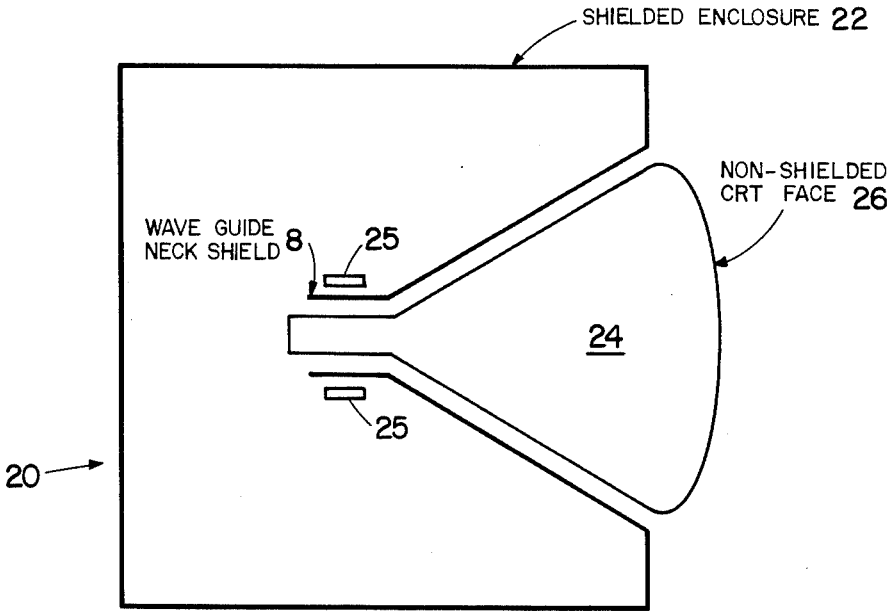
FIG. 2 is a plan view of a shielded CRT enclosure which may be used in combination with the invention.

As best shown in FIG. 2, the RF emissions from a CRT display housing 20 are thwarted by a shielded enclosure 22 and the RF emission shield 8. The RF emission shield 8 is located coaxially with the neck of the CRT 24. The RF emission shield 8 is interposed between the neck of the CRT 24 and the deflection coils 25. The RF emission shield 8 prevents the egress of electromagnetic radiation from the non-shielded CRT face 26 and does not shield the electron beam from the deflection field itself. The RF emission shield 8 negates the need for a transparent conductive screen, not shown, to be placed in front of the CRT face 26. A transparent conductive screen would need to be bonded to the shielded enclosure 22 to prevent the egress of electromagnetic radiation from the CRT 24.

Figure 3:
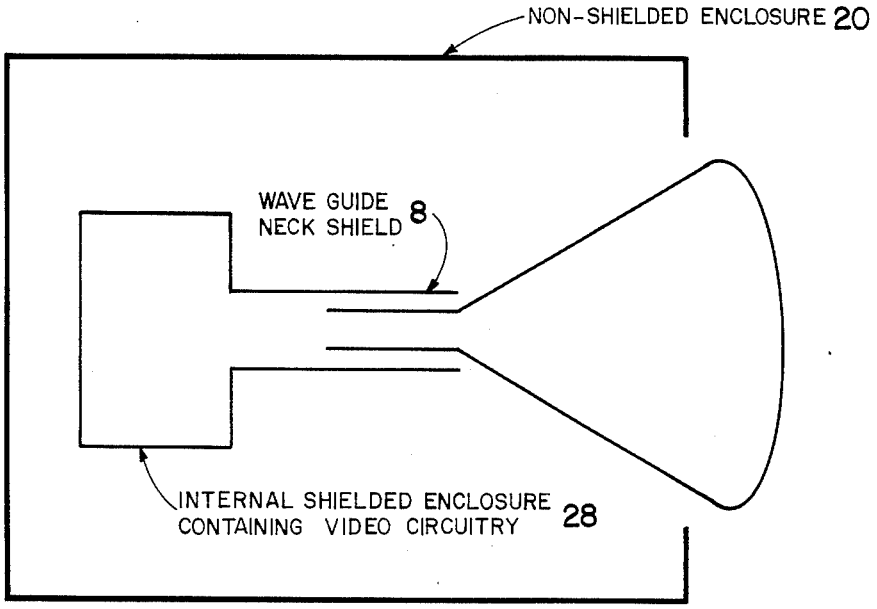
FIG. 3 is a plan view of an alternative shielded video circuit enclosure which may be used with the invention.

An alternative embodiment for thwarting RF emissions from a CRT display housing 20 is best shown in FIG. 3. An internal enclosure 28 shields RF emissions from the various sources of potential undesired emissions found in the video circuitry. The internal enclosure 28 is bonded to the RF emission shield 8. The alternative configuration eliminates the requirement for shielding the entire enclosure.

While the invention has been described in terms of the preferred embodiment which combines a set of longitudinally conductive fingers with a set of circumferentially conductive hoops to eliminate both transverse magnetic ($TM_{01}$, $TM_{02}$ . . . ) mode and transverse electric ($TE_{01}$, $TE_{02}$ . . . ) mode radiations from the CRT display face, those skilled in the art will recognize that the configuration of the fingers and hoops may be varied in the practice of the invention within the spirit and scope of the appended claims.

Having thus described our invention, what we claim as novel and desire to secure by Letters Patent is the following:

1. A radio frequency emissions shield for inhibiting electromagnetic energy in the radio frequency range from being transmitted through the display face of a cathode ray tube, said shield being coaxial with the neck of said tube and comprising:

a plurality of parallel, spaced, longitudinal conductive elements which support the transverse magnetic guide mode, each of said longitudinal conductive elements having a first end and a second end;

a plurality of spaced, circular conductive elements which support the transverse electric guide mode, said circular conductive elements being orthogonal to said longitudinal conductive elements; and said circular conductive elements being mechanically connected to a single longitudinal conductive element of said plurality of longitudinal conductive elements which give mechanical support and facilitate the RF emission shield's fabrication, said plurality of longitudinal conductive elements being electrically connected at either said first end or said second end.

2. A radio frequency emissions shield for inhibiting electromagnetic energy in the radio frequency range from being transmitted through the display face of a cathode ray tube, said shield being coaxial with the neck of said tube and comprising:

a plurality of parallel, spaced, longitudinal conductive elements which support the transverse magnetic guide mode, each of said longitudinal conductive elements having a first end and a second end;

a plurality of spaced, circular conductive elements which support the transverse electric guide mode, said circular conductive elements being orthogonal to said longitudinal conductive elements;

wherein said longitudinal conductive elements and said circular conductive elements are printed on opposite sides of a flexible dielectric support, using printed circuit techniques.

3. A shielded cathode ray tube display which inhibits the radiation of electromagnetic energy in the radio frequency range comprising:

a cathode ray tube having a neck portion and a non-shielded face;

a housing with an aperture for holding said cathode ray tube, said non-shielded face of said cathode ray tube fitting in said aperture;

a radio frequency emissions shield positioned coaxially with said neck portion of said cathode ray tube, which includes a plurality of parallel, spaced, longitudinal conductive elements which support the transverse magnetic guide mode, each of said longitudinal conductive elements having a first end and a second end, and a plurality of spaced, circular conductive elements which support the transverse electric guide mode, said circular conductive elements being orthogonal to said longitudinal conductive elements, said radio emissions shield suppressing electromagnetic energy in the transverse magnetic mode and electromagnetic energy in the transverse electric mode from being transmitted through said non-shielded face of said cathode ray tube; and an inhibiting means comprises a radio frequency shielded enclosure contiguous with said housing and electrically connected to said shield for inhibiting radio frequency electromagnetic energy from being transmitted from said housing.

4. A shielded cathode ray tube display which inhibits the radiation of electromagnetic energy in the radio frequency range comprising:

a cathode ray tube having a neck portion and a non-shielded face;

a housing with an aperture for holding said cathode ray tube, said non-shielded face of said cathode ray tube fitting in said aperture;

a radio frequency emissions shield positioned coaxially with said neck portion of said cathode ray tube, which includes a plurality of parallel, spaced, longitudinal conductive elements which support the transverse magnetic guide mode, each of said longitudinal conductive elements having a first end and a second end, and a plurality of spaced, circular conductive elements which support the transverse electric guide mode, said circular conductive elements being orthogonal to said longitudinal conductive elements, said radio emissions shield suppressing electromagnetic energy in the transverse magnetic mode and electromagnetic energy in the transverse electric mode from being transmitted through said non-shielded face of said cathode ray tube; and an inhibiting means includes an internal radio frequency shielded compartment, said internal compartment containing all sources of potentially undesired radio frequency emission, said internal compartment being bonded to said radio frequency emissions shield, the inhibiting means electrically connected to said shield for inhibiting radio frequency electromagnetic energy from being transmitted from said housing.

5. A method for shielding the emission of radio frequency electromagnetic energy through a non-shielded face portion of a cathode ray tube having a neck portion comprising the step of providing a waveguide coaxial with said neck portion for suppressing a transverse magnetic mode and a transverse electric mode of electromagnetic energy propagation, wherein the cathode ray tube is mounted in a housing, and the step of electrically connecting a radio frequency shielded enclosure contiguous with said housing to said waveguide.

6. A method for shielding the emission of radio frequency electromagnetic energy through a non-shielded face portion of a cathode ray tube having a neck portion comprising the step of providing a waveguide coaxial with said neck portion for suppressing a transverse magnetic mode and a transverse electric mode of electromagnetic energy propagation, wherein the cathode ray tube is mounted in a housing having video circuitry contained in a radio frequency shielded enclosure and the step of electrically connecting said radio frequency shielded enclosure to said waveguide.

* * * * *